US005224887A

United States Patent [19]

Futaki

[11] Patent Number: 5,224,887

[45] Date of Patent: Jul. 6, 1993

[54] SCREEN FOR WATERCRAFT JET PROPULSION UNIT

[75] Inventor: Yoshiki Futaki, Iwata, Japan

[73] Assignee: Yamaha Hatsudoki Kabushiki Kaisha, Iwata, Japan

[21] Appl. No.: 830,732

[22] Filed: Feb. 4, 1992

[30] Foreign Application Priority Data

Feb. 8, 1991 [JP] Japan ..... 3-17486

[51] Int. Cl.[5] ..... B63H 11/01

[52] U.S. Cl. ..... 440/46

[58] Field of Search ..... 440/38, 40–43, 440/46

[56] References Cited

U.S. PATENT DOCUMENTS 3,226,033 12/1965 Cochran ..... 440/41 X
3,295,490 1/1967 Hiatt ..... 440/41
3,478,712 11/1969 Fox ..... 440/43 X
3,494,320 2/1970 Stubblefield ..... 440/40

FOREIGN PATENT DOCUMENTS 14789 1/1991 Japan ..... 440/46

*Primary Examiner*—Sherman Basinger
*Attorney, Agent, or Firm*—Ernest A. Beutler

[57] ABSTRACT

A jet propulsion for watercraft having a screen that extends across the water inlet opening of the jet propulsion unit for precluding foreign articles from entering the jet propulsion unit. The jet propulsion unit water inlet opening is supported for movement between a lowered driving position and an elevated service position. The screen is held in its closed position when the jet propulsion unit is in its driving position and may be pivoted to an open position when the jet propulsion unit is elevated.

33 Claims, 5 Drawing Sheets

SCREEN FOR WATERCRAFT JET PROPULSION UNIT

BACKGROUND OF THE INVENTION

This invention relates to a screen for a watercraft jet propulsion unit and more particularly to an improved inlet screen construction that can be conveniently opened for servicing of the water inlet portion of a jet propulsion unit.

Jet propelled watercraft have a number of advantages. In addition to providing a propulsion system that has a number of advantages over propeller type watercraft, a jet propelled watercraft can have a very neat appearance if the jet propulsion unit is positioned at least in substantial portion within a tunnel on the under side of the watercraft hull. However, there are times when it is desirable to access the water inlet opening of the jet propulsion unit for servicing.

One of the advantages of jet propulsion units is that they permit the watercraft to be operated in very shallow bodies of water. However, when operating in such shallow bodies of water, it is possible to ingest seaweed and other foreign materials into the jet propulsion unit which must be removed to preclude clogging of the unit.

It has also been proposed to provide some form of inlet screen across the opening of the jet propulsion unit so as to preclude large articles from being drawn into the jet propulsion unit and damaging the impeller and its internal components. Of course, if such a screen is employed then it must be removed in order to clear smaller articles which may have entered past the screen and become lodged in the water inlet opening of the jet propulsion unit.

In order to facilitate the servicing of jet propulsion units and particularly those which are mounted in or beneath the hull of the watercraft, it has been proposed to mount either the entire jet propulsion unit or portions of it for movement between their normal driving position and a service position. In the service position, the water inlet opening may be rotated to a raised position for offering access through an access opening in the hull which defines the tunnel in which the jet propulsion unit is contained. The co-pending application of Noboru Kobayashi entitled, "Water Jet Propulsion Unit," Ser. No. 735,154 filed Jul. 22, 1991, which is a continuation of his application Ser. No. 489,361, filed Mar. 6, 1991 and now abandoned, which applications are assigned to the assignee hereof, shows a number of jet propelled watercraft wherein the water inlet opening may be accessed for servicing.

Again, with this type of jet propulsion unit it is also desirable to provide a screen across the inlet opening to exclude large foreign articles. However, the screen must be removed in order to permit servicing of the inlet opening and the removal of foreign objects therefrom. This gives rise to some disadvantages with the prior art type of constructions.

It is, therefore, a principal object of this invention to provide an improved screen arrangement for the water inlet opening of a jet propulsion unit which can be easily opened for servicing and which requires no complex latching arrangement.

It is a further object of this invention to provide an improved water jet propulsion unit for a watercraft having a screen over its water inlet portion which can be easily opened for servicing.

SUMMARY OF THE INVENTION

This invention is adapted to be embodied in a jet propelled watercraft having a hull defining at least in part a tunnel and in which at least a portion of a jet propulsion unit is contained. The jet propulsion unit includes a portion that forms a water inlet opening through which water is drawn for propelling the watercraft and a screen is supported for movement relative to the water inlet opening between an operating position for screening objects from entry into the water inlet opening and a service position wherein the water inlet opening is accessible. Means support at least the water inlet opening forming portion within the tunnel for movement between a lowered driving position and a raised service position. A service opening is formed within the hull through which the screen and water inlet opening may be accessed when the water inlet opening is in its raised service position.

Another feature of the invention is adapted to be embodied in a jet propulsion unit having an outer housing defining a water inlet portion having a water inlet opening. A screen is supported for pivotal movement along a peripheral edge of the opening for movement between a normal position wherein the screen spans the water inlet opening and an opened position. Biasing spring means urges the screen to its normal operative position.

DETAILED DESCRIPTION OF THE PREFERRED EMBODIMENT OF THE INVENTION

Figure 1:
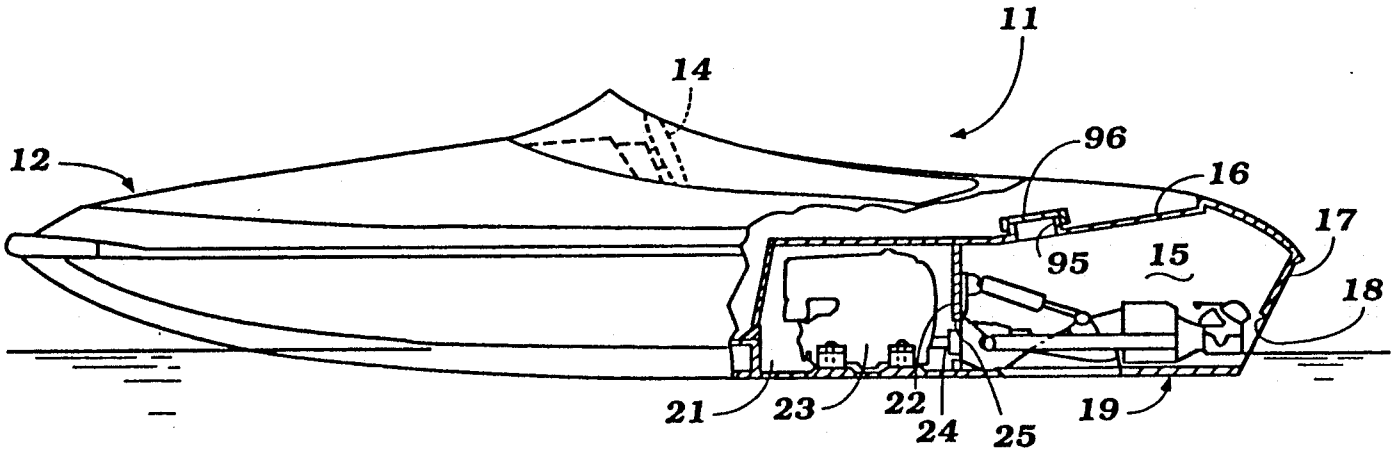
FIG. 1 is a side elevational view of a watercraft propelled by a jet propulsion unit constructed in accordance with an embodiment of the invention and shown in its operating condition in a body of water, with a portion broken away.

Referring first in detail to FIG. 1, a jet propelled watercraft constructed in accordance with an embodiment of the invention is identified generally by the reference numeral 11. The watercraft 11 has a hull assembly, indicated generally by the reference numeral 12 and which may have any known construction. The hull 12 defines a rider's and/or passenger's compartment 13 toward the rear portion of the hull 12 and in which a control area 14 is provided that offers access for the various controls of the watercraft such as its steering, throttle, reverse operation, etc.

A tunnel 15 is formed at the rear portion of the hull 12 on its under side and at the rear portion of the rider's compartment 13. The tunnel 15 is defined by a generally horizontally extending upper surface 16 and a transom 17 having a partial opening 18 at the rear portion thereof, for a reason to be described. A jet propulsion unit, indicated generally by the reference numeral 19, is supported within the tunnel 15 and is movable, as will be described, from a lowered driving position as shown in FIG. 1 and in the solid line view of FIG. 2 to an elevated storage or service position as shown in the phantom line view of FIG. 2.

An engine compartment 21 is formed forwardly of the tunnel 15 and is divided therefrom by a bulkhead 22. A powering internal combustion engine 23 is positioned in the engine compartment 21 and has an output shaft 24 that is rotatable about a longitudinally extending axis and which extends through an opening 25 in the bulkhead 22 for driving the jet propulsion unit 19 in a manner now to be described by particular reference to FIGS. 2 and 3.

Jet propulsion unit 19 is comprised of an outer housing which includes a water inlet portion 26 that has an inlet duct 27 which extends from an inlet opening defined by an outwardly extending flange 28 and across which a screen 29 is provided for preventing the ingestion of large foreign objects. The screen 29 is disposed at an angle so that it does not extend downwardly below the bottom of the hull 12 but tapers toward its rear edge so that any foreign material which may become lodged in the screen can easily flow backward along the length of the screen 29 and be discharged along the under side of the hull 12.

The water inlet portion 26 has a further flange 31 to which a corresponding flange 32 of an impeller housing 33 is affixed with interposed gaskets and spacer plates 34. The rear portion of the impeller housing 33 is provided with a plurality of straightening vanes 35 which extend from a nacelle 36. The nacelle 36 forms a rear bearing support for an impeller shaft 37 with an impeller 38 being affixed to this impeller shaft 37 forwardly of the nacelle 36 and straightening vanes 35. The impeller shaft 36 and impeller 38 are driven from the engine 23 in a manner to be described and this action draws water through the inlet passage way 27.

The impeller housing 33 has a cylindrical outer portion that is journaled in a bushing 39 that is carried by a support assembly comprised of first and second plates 41 and 42 that are fixed to each other in a suitable manner. A discharge nozzle 43 is affixed to the support plate 42 and receives water that is driven past the straightening vanes 35 by the impeller 38. A steering nozzle 44 is pivotally supported by means of pivot pins 45 for steering movement about a vertically extending axis at the end of the discharge nozzle 43. The steering nozzle 44 is coupled for steering movement to the controls 14 by means of a bowden wire actuator 46.

A reverse thrust bucket 47 is pivotally supported on the steering nozzle 44 by means of a pair of aligned pivot pins 48. An actuating lever 49 is also pivotally supported on the steering nozzle 44 by means of respective pivot pins 51 and has a pin and slot connection to the reverse thrust bucket 47 for moving it from a forward drive position as shown in solid lines in FIG. 2 to a reverse thrust position as shown in phantom lines in this figure. A bowden wire actuator 52 is connected to the actuating lever 49 for effecting this movement of the reverse thrust bucket 47.

The jet propulsion unit 19 is supported as a unit within the tunnel 15 by means of a cradle assembly, indicated generally by the reference numeral 53. The cradle assembly 53 has an upstanding forward portion 54 that is affixed to the bulkhead 22 on the tunnel side thereof. A horizontally extending portion 55 extends rearwardly from the upstanding portion 54 and underlies at least in part the jet propulsion unit 19. This horizontally extending part has an upwardly extending surface that terminates in a downwardly inclined flange 56 that defines a water inlet opening 57 which is, in turn, aligned with the inlet opening 27 of the jet propulsion unit 19 when the jet propulsion unit is in its normal driving position.

The impeller shaft 37 extends forwardly through a pilot portion 58 of the water inlet portion 56. A bearing and seal assembly 59 is inserted into the pilot portion 58 and journals the forward end of the impeller shaft 37. A universal joint assembly, indicated generally by the reference numeral 61, has a splined connection to the forward end of the impeller shaft 37 and a splined connection to a coupling 62 which is, in turn, affixed to the engine output shaft 24 so as to provide a driving connection between the engine 23 and the impeller 38, which connection is also pivotal about an axis now to be described.

The pilot bearing member 59 has a pair of forwardly extending arms 62 that have a pivotal connection to a pair of rearwardly extending arms 63 of a trunnion 64 formed integrally with the upstanding cradle portion 54. A pair of aligned pivot pins 65 form this pivotal connection and this pivotal connection is coincident with a pivot axis of the universal joint 61.

A pair of support arms 66 are disposed on opposite sides of the jet propulsion unit 19 and have pivotal connections at their forward ends to upstanding side walls 67 of the cradle assembly 53 by means of pivot pins 68. This pivotal connection is also aligned with the pivotal connection provided by the pivot pins 65 and the universal joint 61. The rear ends of the support arms 66 are affixed to bearing blocks 69 which are in turn affixed to the support rings 41 and 42.

A pair of hydraulic cylinders 71 have their cylinder portions pivotally connected to trunnions 72 of the support cradle portion 54 by means of pivot bolts 73. The rods of the hydraulic cylinders 71 are connected by means of pivot pins 74 to upstanding portions 75 of the support arms 66.

Figure 2:
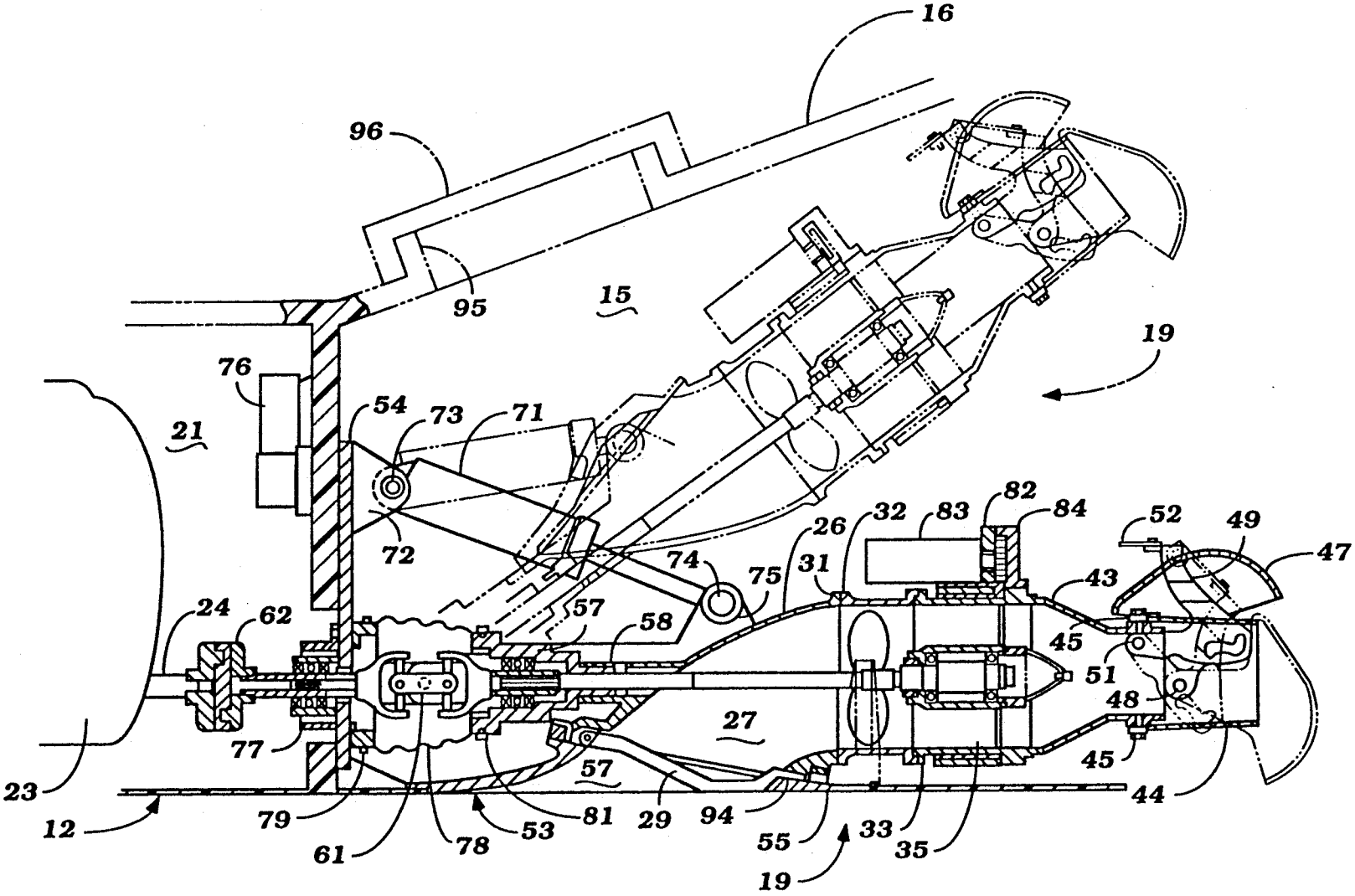
FIG. 2 is an enlarged cross-sectional view of the broken away area depicted in FIG. 1 and shows the construction of the jet propulsion unit and its association with the watercraft.
Figure 3:
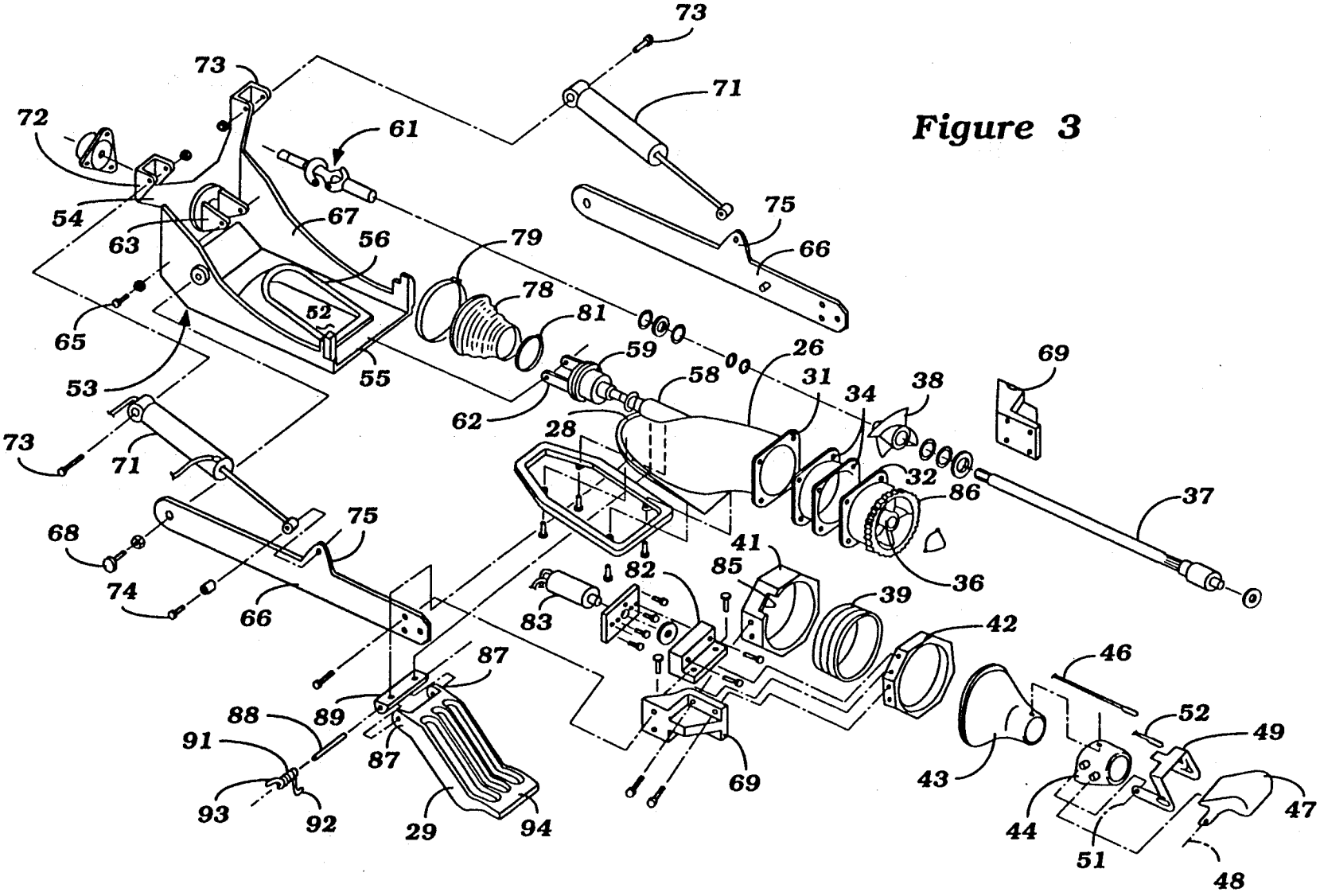
FIG. 3 is an exploded perspective view of the jet propulsion unit.
Figure 4:
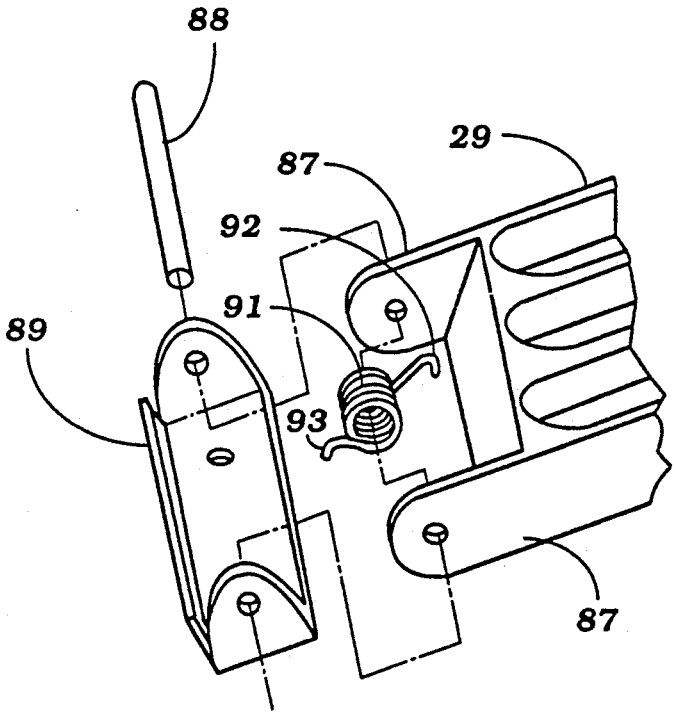
FIG. 4 is an exploded perspective view showing the supporting arrangement for the water inlet opening screen.
Figure 5:
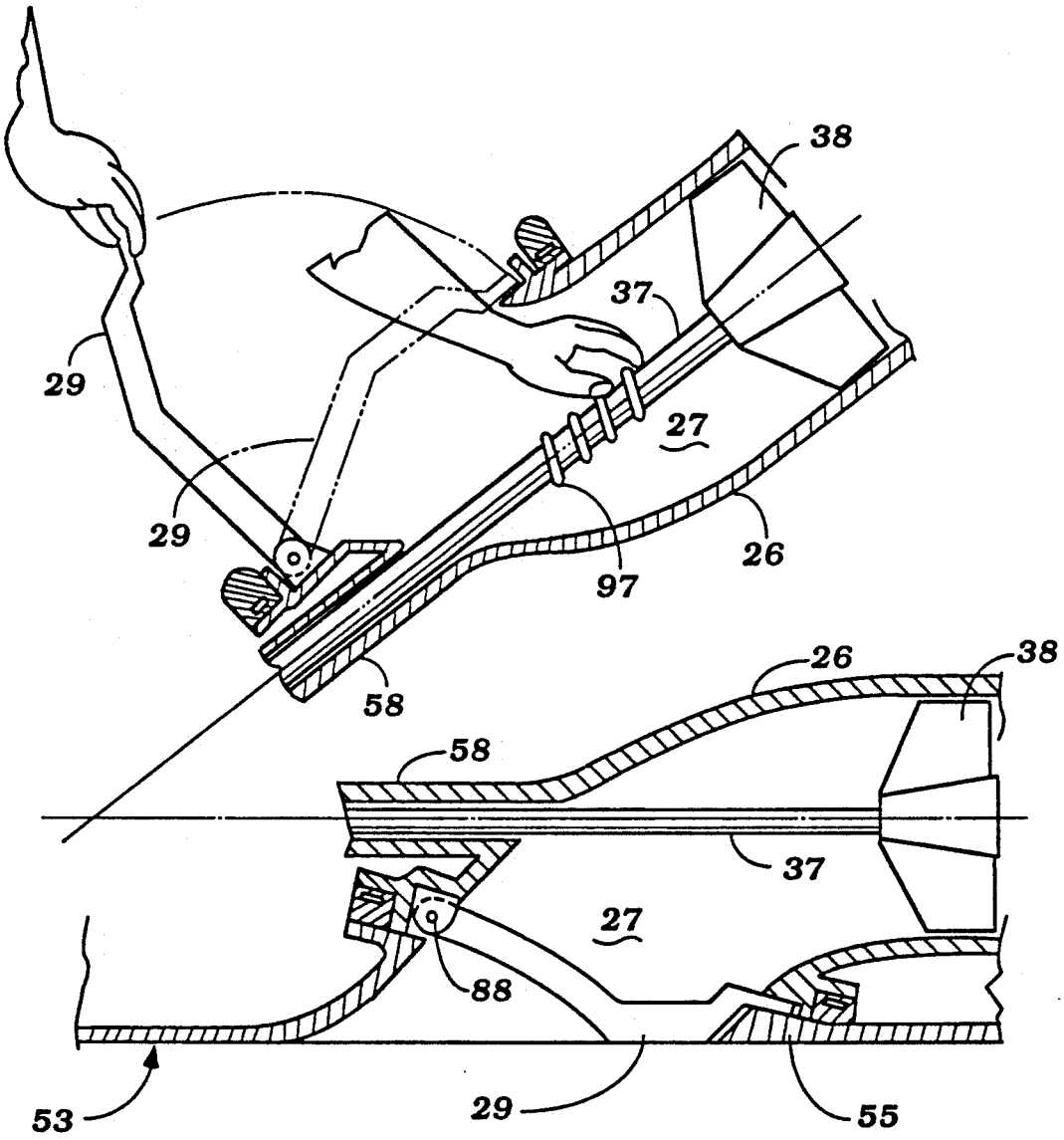
FIG. 5 is a further enlarged cross-sectional view, in part similar to FIG. 2, and shows how the water inlet opening screen may be opened for accessing the water inlet opening of the jet propulsion unit.

A reversible electric motor hydraulic pump assembly 76 is mounted on the engine compartment side of the bulkhead 22 and supplies hydraulic fluid to actuate the hydraulic cylinders 71 so as to pivot the jet propulsion unit 19 about the transverse horizontally disposed pivot axis defined by the pivot pins 63., 68 and universal joint 61 between a lowered normal driving position and an elevated out-of-the-water service position as shown in FIG. 2. The control for this movement will be described later.

A sealing and bearing assembly 77 is affixed to the forward side of the cradle portion 54 for journaling the coupling 62 and forward portion of the universal joint 61.

An elastic boot 78 encircles the universal joint 61 and is affixed to the trunnion portion 64 of the cradle assembly by a first clamp 79 and to the bearing block 59 by a second clamp 81. The flexible boot 78 provides sealing around the universal joint 61, accommodates the aforenoted pivotal movement about the transversely extending horizontal pivotal axis and also permits rotation of the water inlet portion 26 and impeller housing portion 33 of the jet propulsion unit 19, which is accomplished in a manner now to be described.

A supporting block 82 is affixed to the support ring 41 and, in turn, carries a reversible electric motor 83. The reversible electric motor 83 has an output shaft to which a gear 84 is affixed and which gear extends through a notch or recess 85 in the support ring 41. The gear 84 meshes with a gear 86 formed integrally on the impeller housing 33. When the electric motor 83 is operated, the water inlet portion 26 and impeller housing 33 will rotate in the bushing 39 from a downwardly facing normal position to an upwardly facing service position as shown in phantom in FIG. 2.

It is desirable to ensure that the rotation of the water inlet portion 26 does not occur until after the jet propulsion unit 19 has been pivoted away from contact with the surface 56 and also that the water inlet portion 26 is rotated to its downwardly facing position before the jet propulsion unit 19 is lowered to its driving position. Any suitable type of control arrangement may be incorporated for this purpose.

Thus, the way the system operates is that when it is desired to elevate the jet propulsion unit 19 and have the water inlet portion 26 rotated upwardly, a switch, to be described, is actuated. Then the reversible motor 76 is operated so as to energize the cylinders 71 and at least begin pivotal movement of the jet propulsion unit 19 about the transversely disposed horizontal axis. Once the flange 28 of the water inlet portion 26 is clear of the surface 56 of the supporting cradle 53, then the electric motor 83 may be energized so as to rotate the water inlet portion 26 and impeller portion 33 from their downwardly facing position to an upwardly facing position. This may be done either after the pivotal movement about the horizontal transverse axis is completed or while this motion is being continued.

When it is desired to return the jet propulsion 19 from its storage position as shown in the phantom line view of FIG. 2 to its driving position, the switch is again actuated. When this occurs, the motor 83 is first energized to rotate the water inlet portion 26 and impeller portion 33 to their downwardly facing positions and actuate the cylinder 71 so as to lower the jet propulsion unit 19. The timing of this sequencing may be as desired, however, it is important to ensure that the water inlet portion 26 is in its downwardly facing position before the jet propulsion unit 19 is fully lowered into engagement with the surface 56.

The way in which the screen 29 is supported from the water inlet portion 26 and how it may be opened for servicing will now be described by particular reference to FIGS. 2–5. It will be noted that the forward end of the screen 29 is provided with a pair of tabs or ears 87. A pivot pin assembly 88 extends through these tabs 87 and through a generally U-shaped mounting bracket 89. The mounting bracket 89 is, in turn, affixed to the flange 28 of the water inlet opening portion 26 of the jet propulsion unit 19 by means of threaded fasteners.

A torsional spring 91 has a first end 92 that bears against the screen 29 and a second end 93 that bears against the mounting bracket 89 and which is of sufficient strength so as to hold the screen 29 in its closed position when the fluid motors 71 are employed to elevate the jet propulsion unit 19. It should be noted that when the jet propulsion unit 19 is in its normal driving position as shown in FIG. 2 and in the lower view of FIG. 5, a trailing end 94 of the screen 29 will be trapped between the cradle portion surface 56 and the lower surface of the flange 28. Hence, no separate latching mechanism is required to hold the screen 29 in its normal operative position.

Also, when the hydraulic motors 71 are operated so as to raise the jet propulsion unit in the manner aforenoted, the spring 91 will hold the screen 29 against the flange 28 and prevent its dropping.

When the water inlet opening 26 is rotated to the upwardly facing position by the motor 83 in the manner aforedescribed, the operator may easily reach through an access opening 95 formed in the hull wall 16 by removing a removable access closure 96. The screen 29 may then be pivoted from the closed position as shown in the phantom line view of FIG. 5 to an open service position as shown in the solid line view of the top portion of this figure. The torsional spring 91 will be further loaded when this is done. Also, it should be noted that the wall 16 is spaced sufficiently above the screen 29 and the screen 29 has a short enough length so as to permit this motion while still contained within the tunnel 15. The operator may then put his hand into the opening 27 and remove foreign material such as a piece of seaweed, indicated by the reference number 97 therefrom which may be clogged on the impeller shaft 37.

After the servicing has been completed, the screen 29 can be moved back to its closed position and will be held there by the spring 91 until the jet propulsion unit 19 is again returned to its operative position in the manner as aforedescribed.

It should be readily apparent that the described construction permits a very effective inlet screen for a jet propulsion unit and one which is held in its closed position without requiring any separately operable latch or the complicated structures associated therewith and yet which may be easily opened for servicing of the jet propulsion unit when it is elevated. Of course, the foregoing description is that of a preferred embodiment of the invention and various changes and modifications may be made without departing from the spirit and scope of the invention, as defined by the appended claims.

I claim:

1. A jet propelled watercraft having a hull defining at least in part a tunnel, a jet propulsion unit having a portion forming a water inlet opening through which water is drawn for propelling said watercraft, a screen supported for movement relative to said water inlet opening between an operative position for screening objects from entry into said water inlet opening and a service position wherein said water inlet opening is accessible, means supporting at least said water inlet opening forming portion within said tunnel for movement between a lowered driving position and a raised service position, said screen being fixed relative to said water inlet opening only when in its lowered drive position for precluding entry of an operator's hand into said water inlet opening and a service opening formed within said hull through which said screen and said water inlet opening may be accessed when said water inlet opening is in its raised service position.

2. A jet propelled watercraft as set forth in claim 1 wherein the tunnel, service opening and screen are configured to permit movement of the screen to its service position within the tunnel.

3. A jet propelled watercraft as set forth in claim 2 wherein the screen is supported for pivotal movement by the water inlet opening forming portion at one side of the water inlet opening.

4. A jet propelled watercraft as set forth in claim 3 wherein the pivotal axis of the screen is at the forward edge of the water inlet opening.

5. A jet propelled watercraft as set forth in claim 4 wherein the rearward edge of the screen is raised relative to the water inlet opening when the screen is in its service position.

6. A jet propelled watercraft as set forth in claim 3 wherein the hull is formed with a portion underlying the water inlet opening and which is engaged by the screen when the water inlet opening is in its lowered driving position for providing means for retaining the screen in its operative position.

7. A jet propelled watercraft as set forth in claim 6 wherein the screen is further biased by biasing spring means to its operative position and for retaining said screen in its operative position when the water inlet opening forming portion is moved between its positions.

8. A jet propelled watercraft as set forth in claim 1 wherein the water inlet opening portion is supported for rotation relative to the hull about a longitudinally extending horizontal axis.

9. A jet propelled watercraft as set forth in claim 8 wherein the tunnel, service opening and screen are configured to permit movement of the screen to its service position within the tunnel.

10. A jet propelled watercraft as set forth in claim 9 wherein the screen is supported for pivotal movement by the water inlet opening forming portion at one side of the water inlet opening.

11. A jet propelled watercraft as set forth in claim 10 wherein the pivotal axis of the screen is at the forward edge of the water inlet opening.

12. A jet propelled watercraft as set forth in claim 11 wherein the rearward edge of the screen is raised relative to the water inlet opening when the screen is in its service position.

13. A jet propelled watercraft as set forth in claim 8 wherein the hull is formed with a portion underlying the water inlet opening and which is engaged by the screen when the water inlet opening is in its lowered driving position for providing means for retaining the screen in its operative position.

14. A jet propelled watercraft as set forth in claim 13 wherein the screen is further biased by biasing spring means to its operative position and for retaining said screen in its operative position when the water inlet opening forming portion is moved between its positions.

15. A jet propelled watercraft as set forth in claim 1 wherein the water inlet opening forming portion is supported for pivotal movement about a transversely extending horizontally disposed axis.

16. A jet propelled watercraft as set forth in claim 15 wherein the tunnel, service opening and screen are configured to permit movement of the screen to its service position within the tunnel.

17. A jet propelled watercraft as set forth in claim 16 wherein the screen is supported for pivotal movement by the water inlet opening forming portion at one side of the water inlet opening.

18. A jet propelled watercraft as set forth in claim 17 wherein the pivotal axis of the screen is at the forward edge of the water inlet opening.

19. A jet propelled watercraft as set forth in claim 18 wherein the rearward edge of the screen is raised relative to the water inlet opening when the screen is in its service position.

20. A jet propelled watercraft as set forth in claim 15 wherein the hull is formed with a portion underlying the water inlet opening and which is engaged by the screen when the water inlet opening is in its lowered driving position for providing means for retaining the screen in its operative position.

21. A jet propelled watercraft as set forth in claim 20 wherein the screen is further biased by biasing spring means to its operative position and for retaining said screen in its operative position when the water inlet opening forming portion is moved between its positions.

22. A jet propelled watercraft as set forth in claim 15 wherein the water inlet opening forming portion is also rotatable about a horizontally disposed longitudinally extending axis.

23. A jet propelled watercraft as set forth in claim 22 wherein the tunnel, service opening and screen are configured to permit movement of the screen to its service position within the tunnel.

24. A jet propelled watercraft as set forth in claim 23 wherein the screen is supported for pivotal movement by the water inlet opening forming portion at one side of the water inlet opening.

25. A jet propelled watercraft as set forth in claim 24 wherein the rearward edge of the screen is raised relative to the water inlet opening when the screen is in its service position.

26. A jet propelled watercraft as set forth in claim 22 wherein the hull is formed with a portion underlying the water inlet opening and which is engaged by the screen when the water inlet opening is in its lowered driving position for providing means for retaining the screen in its operative position.

27. A jet propelled watercraft as set forth in claim 26 wherein the screen is further biased by biasing spring means to its operative position and for retaining said screen in its operative position when the water inlet opening forming portion is moved between its positions.

28. A jet propelled watercraft having a hull defining a water inlet, a jet propulsion unit having a portion forming a water inlet opening through which water is drawn for propelling said watercraft, means for supporting said water inlet opening forming portion for movement between a driving position in which said water inlet opening is in registry with said hull water inlet and a service position, a screen supported contiguous to said jet propulsion unit water inlet opening at least when said water inlet opening is in its driving position, said hull opening, said screen and said water inlet opening cooperating for precluding the flow of water into said jet propulsion unit water inlet opening without passing through said screen when said water inlet opening is in its driving position, and for prohibiting an operator to pass his hand beyond said screen only when said water inlet opening is in its driving position and for permitting said water inlet opening to be accessed by the hand of an operator when said water inlet opening is in its service position.

29. A jet propelled watercraft as set forth in claim 28 wherein the screen is supported by the jet propulsion unit contiguous to the water inlet opening.

30. A jet propelled watercraft as set forth in claim 29 wherein the screen is supported for pivotal movement relative to the water inlet opening.

31. A jet propelled watercraft as set forth in claim 30 wherein the pivotal axis of the screen is at the forward edge of the water inlet opening.

32. A jet propelled watercraft as set forth in claim 30 wherein the hull is formed with a portion underlying the water inlet opening and which is engaged by the screen when the water inert opening is in its driving position for retaining the screen in a closed position to preclude the flow of water into said water inlet opening without passing through said screen.

33. A jet propelled watercraft as set forth in claim 32 wherein the screen is further biased by biasing spring means to an operative position and for retaining said screen in its operative position when the water inlet opening forming portion is moved between its positions.

* * * * *